US007841974B2

(12) United States Patent
Hartjes et al.

(10) Patent No.: US 7,841,974 B2
(45) Date of Patent: Nov. 30, 2010

(54) METHOD OF MAKING A CONTAINER EMPLOYING INNER LINER AND VENTS FOR THERMAL INSULATION

(75) Inventors: Timothy P. Hartjes, Kimberly, WI (US); Michael A. Breining, Neenah, WI (US); Gerald J. Van Handel, Neenah, WI (US); David C. Brown, Kingston, PA (US); Walter Malakhow, Phillipsburg, NJ (US)

(73) Assignee: Dixie Consumer Products LLC, Atlanta, GA (US)

( * ) Notice: Subject to any disclaimer, the term of this patent is extended or adjusted under 35 U.S.C. 154(b) by 0 days.

(21) Appl. No.: 12/380,314

(22) Filed: Feb. 26, 2009

(65) Prior Publication Data

US 2009/0170679 A1 Jul. 2, 2009

Related U.S. Application Data

(60) Division of application No. 11/478,075, filed on Jun. 29, 2006, now Pat. No. 7,510,098, which is a continuation-in-part of application No. 11/174,434, filed on Jun. 30, 2005, now Pat. No. 7,513,386.

(51) Int. Cl.
*B31B 1/00* (2006.01)

(52) U.S. Cl. ..... 493/153; 493/379; 493/155

(58) Field of Classification Search ..... 493/379, 493/110, 903, 52, 153, 155; 229/400, 403, 229/4; 220/417, 454, 455, 457, 62.12, 62.18, 220/62.2, 667
See application file for complete search history.

(56) References Cited

U.S. PATENT DOCUMENTS 593,316 A 11/1897 Woodman
1,157,008 A 10/1915 Lang
1,407,688 A 2/1922 Banton
1,756,243 A 4/1930 Benson
1,944,042 A 1/1934 Thompson
2,266,828 A 12/1941 Sykes (Continued)

FOREIGN PATENT DOCUMENTS

JP 57-065158 A 4/1982

(Continued)

OTHER PUBLICATIONS

International Search Report for PCT/US2006/025916 having a mail date of Mar. 11, 2006.

(Continued)

*Primary Examiner*—Sameh H. Tawfik

(57) ABSTRACT

The present invention provides a container (10) suitable for providing insulation wherein the container has an inner shrink film (14) liner. The sidewalls of the container, which can be made from paperboard or other suitable material, are vented to allow ambient air to freely flow through the sidewall of the container during activation of the shrink film (14) with hot liquid or other suitable material. When the container is filled with material having a temperature of from about 130° F. to up to about 212° F., the shrink film (14) is activated and the container (10) provides excellent insulation, thereby allowing the container to be held in a consumer's hand for an extended period without causing burns or excessive discomfort. Method of making this container (10) are also provided.

11 Claims, 5 Drawing Sheets

U.S. PATENT DOCUMENTS

| | | | |
|---|---|---|---|
| 2,563,352 | A | 8/1951 | Morse |
| 2,678,764 | A | 5/1954 | Carlson |
| 2,853,222 | A | 9/1958 | Gallagher |
| 2,961,849 | A | 11/1960 | Hitchcock |
| 3,082,900 | A | 3/1963 | Goodman |
| 3,134,307 | A | 5/1964 | Loeser |
| 3,203,611 | A | 8/1965 | Anderson et al. |
| 3,237,834 | A | 3/1966 | Davis et al. |
| 3,246,745 | A | 4/1966 | Stoker, Jr. |
| 3,402,874 | A | 9/1968 | Sternall |
| 3,406,814 | A | 10/1968 | Gulliver |
| 3,627,166 | A | 12/1971 | Walter |
| 3,737,093 | A | 6/1973 | Amberg et al. |
| 3,781,183 | A | 12/1973 | Doll |
| 3,854,583 | A | 12/1974 | Amberg et al. |
| 3,988,521 | A | 10/1976 | Fumel et al. |
| 3,995,740 | A | 12/1976 | Amberg et al. |
| 4,051,951 | A | 10/1977 | Smith |
| 4,087,003 | A | 5/1978 | Adamek |
| 4,197,948 | A | 4/1980 | Amberg et al. |
| 4,261,501 | A | 4/1981 | Watkins et al. |
| 4,332,635 | A | 6/1982 | Holbrook et al. |
| 4,359,160 | A | 11/1982 | Myers et al. |
| 4,383,422 | A | 5/1983 | Gordon et al. |
| 4,398,904 | A | 8/1983 | Fagerberg |
| 4,435,344 | A | 3/1984 | Iioka |
| 4,452,596 | A | 6/1984 | Clauss et al. |
| 4,459,793 | A | 7/1984 | Zenger |
| 4,486,366 | A | 12/1984 | Reddy |
| 4,514,354 | A | 4/1985 | Schlesinger et al. |
| 4,551,366 | A | 11/1985 | Maruhashi et al. |
| 4,679,724 | A | 7/1987 | Inagaki |
| 4,692,132 | A | 9/1987 | Ikushima et al. |
| 4,923,557 | A | 5/1990 | Dickey |
| 4,971,845 | A | 11/1990 | Aaker et al. |
| 4,982,872 | A | 1/1991 | Avery |
| 4,985,300 | A | 1/1991 | Huang |
| 5,001,016 | A | 3/1991 | Kondo et al. |
| 5,063,005 | A | 11/1991 | Doheny, Jr. |
| 5,092,485 | A | 3/1992 | Lee |
| 5,145,107 | A | 9/1992 | Silver et al. |
| 5,205,473 | A | 4/1993 | Coffin, Sr. |
| 5,217,307 | A | 6/1993 | McClintock |
| 5,279,872 | A | 1/1994 | Ralph |
| 5,460,323 | A | 10/1995 | Titus |
| 5,469,983 | A | 11/1995 | Yawata |
| 5,490,631 | A | 2/1996 | Iioka et al. |
| 5,700,689 | A | 12/1997 | Wuster |
| 5,707,751 | A | 1/1998 | Garza et al. |
| 5,725,916 | A | 3/1998 | Ishii et al. |
| 5,736,231 | A | 4/1998 | Todt |
| 5,766,709 | A | 6/1998 | Geddes et al. |
| 5,840,139 | A | 11/1998 | Geddes et al. |
| 5,882,612 | A | 3/1999 | Riley |
| 5,952,068 | A | 9/1999 | Neale et al. |
| 5,954,217 | A | 9/1999 | Brkovic et al. |
| 5,993,705 | A | 11/1999 | Grischenko et al. |
| 6,030,476 | A | 2/2000 | Geddes et al. |
| 6,085,970 | A | 7/2000 | Sadlier |
| 6,098,829 | A | 8/2000 | McHenry et al. |
| 6,129,653 | A | 10/2000 | Fredericks et al. |
| 6,139,665 | A | 10/2000 | Schmelzer et al. |
| 6,142,331 | A | 11/2000 | Breining et al. |
| 6,152,363 | A | 11/2000 | Rule, Jr. |
| 6,224,954 | B1 | 5/2001 | Mitchell et al. |
| 6,364,149 | B1 | 4/2002 | Smith |
| 6,536,657 | B2 | 3/2003 | Van Handel |
| 6,729,534 | B2 | 5/2004 | Van Handel |
| 6,852,381 | B2 | 2/2005 | Debraal et al. |
| 6,872,462 | B2 | 3/2005 | Roberts et al. |
| 6,908,687 | B2 | 6/2005 | Mendes et al. |
| 7,281,650 | B1 | 10/2007 | Milan |
| 7,464,856 | B2 | 12/2008 | Van Handel |
| 7,464,857 | B2 | 12/2008 | Van Handel |
| 7,510,098 | B2 | 3/2009 | Hartjes et al. |
| 7,513,386 | B2 | 4/2009 | Hartjes et al. |
| 7,600,669 | B2 | 10/2009 | Van Handel |
| 2003/0015582 | A1 | 1/2003 | Van Handel |
| 2003/0021921 | A1 | 1/2003 | Debraal et al. |
| 2003/0121963 | A1 | 7/2003 | Van Handel |
| 2004/0170814 | A1 | 9/2004 | Van Handel |
| 2005/0029337 | A1 | 2/2005 | Van Handel |
| 2005/0184074 | A1 | 8/2005 | Simmons et al. |
| 2007/0000931 | A1 | 1/2007 | Hartjes et al. |
| 2007/0029332 | A1 | 2/2007 | Hartjes et al. |
| 2007/0114271 | A1 | 5/2007 | Van Handel |
| 2007/0240811 | A1 | 10/2007 | Baggot et al. |
| 2008/0093434 | A1 | 4/2008 | Van Handel |
| 2010/0224529 | A1 | 9/2010 | Forloni |
| 2010/0224637 | A1 | 9/2010 | Ikeda et al. |

FOREIGN PATENT DOCUMENTS

| | | | |
|---|---|---|---|
| JP | 06-219474 | A | 8/1994 |
| JP | 2000-177785 | A | 6/2000 |
| WO | 2007/005793 | A1 | 1/2007 |

OTHER PUBLICATIONS

Williams, Mark B. et al. "Investigation of Spatial Resolution and Efficiency Using Pinholes with Small Pinhole Angle." Nuclear Science Symposium Conference Record, 2002 IEEE. Nov. 10-16, 2002, p. 1760-1764 vol. 3.

METHOD OF MAKING A CONTAINER EMPLOYING INNER LINER AND VENTS FOR THERMAL INSULATION

CLAIM FOR PRIORITY AND CROSS-REFERENCE TO RELATED APPLICATIONS

This application is a divisional of U.S. application Ser. No. 11/478,075, filed Jun. 29, 2006, entitled "Container Employing Inner Liner and Vents for Thermal Insulation and Methods of Making Same" now U.S. Pat. No. 7,510,098. U.S. application Ser. No. 11/478,075 is a continuation-in-part application of U.S. application Ser. No. 11/174,434 filed Jun. 30, 2005, entitled "Container Employing and Inner Liner for Thermal Insulation", now U.S. Pat. No. 7,513,386. The priorities of U.S. application Ser. No. 11/478,075 and U.S. application Ser. No. 11/174,434 are hereby claimed and their disclosures are incorporated herein in their entireties by this reference.

FIELD OF THE INVENTION

The present invention provides a container suitable for providing insulation wherein the container has an inner shrink film liner. The sidewalls of the container, which can be made from paperboard or other suitable material, are vented to allow ambient air to freely flow through the sidewall of the container during activation of the shrink film with hot liquid or other suitable material. When the container is filled with material having a temperature of from about 130° F. to up to about 212° F., the shrink film is activated and the container provides excellent insulation, thereby allowing the container to be held in a consumer's hand for an extended period without causing burns or excessive discomfort. Methods of making this container are also provided.

BACKGROUND OF THE INVENTION

U.S. Pat. Nos. 6,536,657 and 6,729,534 and U.S. Patent Publication No. 2005-0029337, which disclosures are incorporated herein in their entireties by this reference, disclose a beverage container having a film adhered to the interior thereof. When the container is filled with a hot liquid, the film will shrink. Upon shrinking, the film moves away from the interior of the container to create a pocket of air. This air pocket results in the container having insulating characteristics. In these referenced patents and application, an insulating band is instantaneously activated (that is, the film shrinks) by contact with hot liquid. The insulated cups formed by the methods and materials set out in the referenced patents were found to provide excellent insulation properties when used for sewing hot beverages, such as coffee, tea, etc. However, in use, when the film began to shrink, a partial vacuum was formed and the film could not fully activate to provide maximum insulation effect.

Other types of insulating cups incorporating a plastic interliner are known. For example, U.S. Pat. No. 3,737,093, which disclosure is incorporated herein in its entirety by this reference, discloses a plastic container situated within a paper container to create an air space for thermal insulation. U.S. Pat. No. 4,435,344, which disclosure is also incorporated in its entirety by this reference, discloses a container made from foam polyethylene-coated paperboard which has insulating properties. More recently, U.S. Pat. No. 6,852,381, which disclosure is incorporated herein in its entirety by this reference, describes an insulated beverage container comprising (in order from the outermost surface to the inside of the container): a paperboard outer shell, a foam layer laminated to the inner surface of the paperboard shell and a film adhered to the foam surface. In use, it appears that the film would be in contact with the beverage in the container to pull wrinkles out of the inner foam layer.

While the above references disclose a number of different configurations for insulated beverage containers, there remains a need in the art for an insulated beverage container that provides suitable insulation properties for use with hot beverages or other hot materials. The present invention meets such a need.

SUMMARY OF THE INVENTION

The present invention provides a container suitable for providing insulation wherein the container has an inner shrink film liner. The sidewalls of the container, which can be made from paperboard or other suitable material, are vented to allow ambient air to freely flow through the sidewall of the container during activation of the shrink film. The shrink film is activated when the container is filled with liquid or other material having a temperature of from about 130° F. to up to about 212° F. The shrink film is applied using an adhesive suitable to prevent the shrink film from undergoing substantially any delamination when contacted with liquid or other material exhibiting these temperatures. When the container is filled with material having a temperature of from about 130° F. to up to about 212° F., the shrink film is activated and the container provides excellent insulation, thereby allowing the container to be held in a consumer's hand for an extended period without causing burns or excessive discomfort. Methods of making this container are also provided.

Additional advantages of the invention will be set forth in part in the description that follows, and in part will be obvious from the description, or may be learned by practice of the invention. The advantages of the invention will be realized and attained by means of the elements and combinations particularly pointed out in the appended claims. It is to be understood that both the foregoing general description and the following detailed description are exemplary and explanatory only and are not restrictive of the invention, as claimed.

DETAILED DESCRIPTION OF THE PRESENT INVENTION

Figure 1:
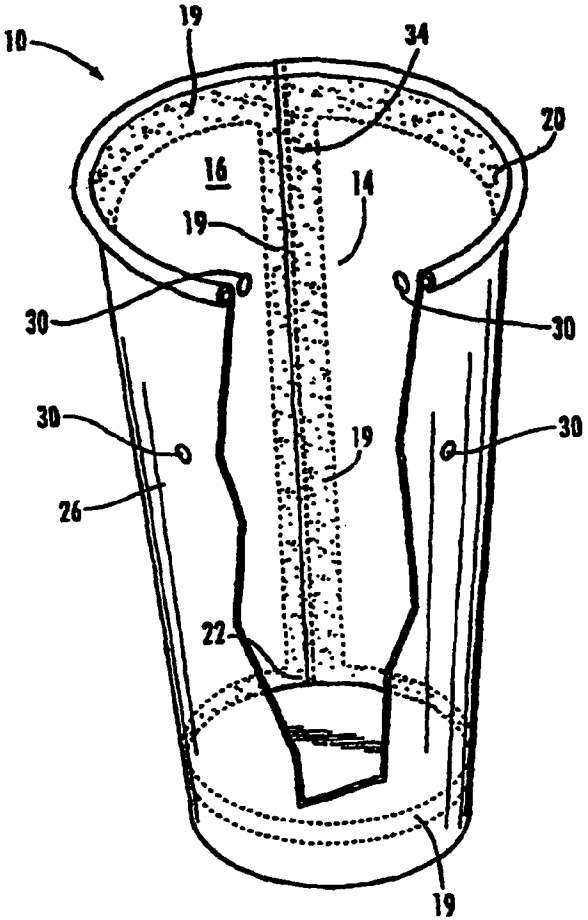
FIG. 1 is a partially cut away front perspective view of a container incorporating an activated shrink film liner.

The present invention may be understood more readily by reference to the following detailed description of the invention and the examples provided herein. Before the present invention is disclosed and described, it is to be understood that the aspects described below are not limited to specific synthetic methods or specific reagents, and as such may vary. It is also to be understood that the terminology used herein is for the purpose of describing particular aspects only and is not intended to be limiting.

Often, ranges are expressed herein as from "about" one particular value, and/or to "about" another particular value. When such a range is expressed, another embodiment includes from the one particular value and/or to the other particular value. Similarly, when values are expressed as approximations, by use of the antecedent "about," it will be understood that the particular value forms another embodiment. It will be further understood that the endpoints of each of the ranges are significant both in relation to the other endpoint, and independently of the other endpoint.

As used herein, "beverage" is used for convenience. The containers of the present invention are suitable for use with not only beverages, but also soups and other hot foods that are held by a consumer during consumption thereof and wherein insulation would be a beneficial aspect. Further, while the containers of the present invention are readily suitable for use for many types of food products, the containers can also be used generally to contain hot items having liquid characteristics.

"Activate" is used herein in relation to the shrink film wherein the shrink film has been contacted with hot material in a manner to provide shrinkage of the film in an amount suitable to provide insulation effects in the container. Such insulation effects are described in more detail herein.

The present invention relates to an insulated container for hot beverages or other materials. The insulated container is formed from a suitable container material and a shrink film liner. The shrink film liner is adhered to the interior of the container as discussed in more detail herein. When a hot material, such as coffee, soup, water etc., is placed in the container, the film will activate to provide a pocket of air between the inner surface of the container sidewall and the inner surface of the shrink film, that is, the film surface facing the inner surface of the container sidewall. This pocket of air reduces the heat transfer from the hot material to the outer surface of the container. An insulated container is therefore provided with the present invention.

Significantly, the insulated container of the present invention includes one or more vents in a portion of the outer wall of the container. Such vents, which are provided by cutting into a web of container material during manufacture of the container, are an improvement over the prior art in which an insulating band adhered to container material without suitable venting was provided.

In use, the vents of the present invention have been found to substantially eliminate the formation of a vacuum in the space between the container sidewall and the shrink film liner. That is, it was found that when suitably sized vents were not present in the area defined by the insulating band, the ability of the shrink film to activate upon contact with a hot liquid was substantially limited by the amount of air present between the not suitably vented container wall and the film liner. In turn, the limited activation of the shrink film provided an air pocket having reduced volume and, accordingly, reduced insulation with the shrink film lined containers.

The inventors herein found that insulation effectiveness using a shrink film-lined container could be markedly improved by allowing air to freely flow through the container sidewall during the activation of the film liner upon contact with a hot material. It was found that such improvements could be obtained by including one or more suitable vents in the container sidewall as described in more detail below.

In one aspect, the vents are punched or otherwise formed in the container material (such as paperboard e.g., cupstock, when the container is made from paper) itself prior to formation of the container blanks. In this form, venting can be efficiently conducted by allowing free flow of air through the container wall when a hot material is poured into the container.

It should be noted that U.S. Pat. No. 6,536,657 (previously incorporated by reference), mentioned the addition of pinholes in the container sidewall or the slitting of the shrink film to assist in alleviating a partial vacuum resulting from shrink film activation. However, the inventors herein found that pinholes were not satisfactory to allow substantially simultaneous activation of the shrink film upon contact of the shrink film with a hot material when used with the insulating band of the present invention. In other words, pinholes did not allow suitable venting. Accordingly, the vents of the present invention do not constitute pinholes. Still further, the vents of the present invention are larger than pinholes. Yet further, the vents of the present invention do not constitute tiny holes punched through the container sidewall as if made by the sharp end of a pin, such as that used for sewing. Still further, the one or more vents of the present invention are each, independently, about 10 times larger than a typical pinhole.

Typically, the need for insulation in a container for beverages or other materials is decreased as the beverage is stored in the container because the beverage will cool over time. A consumer will desire an insulating effect as long as the beverage is hot enough to cause discomfort when a container is held in the hand. The insulated container of the present invention is suitable to provide insulation such that the beverage container will have an external temperature of about 120° F. or less at the insulated portion of the container when held in a consumer's hand about 30 seconds after the container is filled with a hot beverage, where the beverage has an initial temperature of up to about 212° F.

The "insulated portion" of the container is that portion of the container that is coextensive with the activated film and is defined by the area interior to the adhesive pattern printed on the container material (as is discussed in more detail below). As would be recognized, the areas of the container that are coextensive with the areas of adhesive will not be co-extensive with the activated film and will constitute minimal, if any, insulation. As such, it is desirable to maximize the amount of insulated area and minimize the amount of uninsulated area.

Still further, the insulated container provides insulation such that the beverage container will have an external temperature of 120° F. or less at the insulated portion of the container when held in a consumer's hand about 60 or about 90 or about 120 seconds or about 5 minutes after the container is filled with a hot material such as a beverage or otherwise, where the hot beverage has an initial temperature of up to about 212° F.

"Initial temperature" means the temperature of the hot material when first placed in the container. As would be understood, hot beverages can be provided at a range of initial temperatures (which are generally from about 160° F. to about 195° F., but sometimes even up to about 212° F., such as with the use of boiling water for tea or instant coffee). For the purpose of the temperatures disclosed and claimed herein, the ambient air temperature is generally at or near about 75° F.

As would be recognized, the hotter the initial temperature of the beverage, the hotter the external surface of the container will be when the container is filled with the hot beverage. Nonetheless, it has been found by the inventors herein that when activated, the insulating band of the present invention provides excellent insulation (that is, the external surface of the container is at or below about 140° F. or at about 120° F. at 5 minutes or less after the container is filled with a beverage having an initial temperature of up to about 212° F.) at all ranges of initial beverage temperatures in which hot beverages are generally served.

It has been found that when a container temperature is higher than about 140° F. (which is defined as the "threshold of pain" in U.S. Pat. No. 6,152,363, the disclosure of which is incorporated herein in its entirety by this reference), a typical consumer will find the container "too hot to handle." However, it is believed that temperatures of as low as about 120° F. can cause discomfort to some sensitive people. The insulated containers of the present invention provide suitable insulation so that the container is substantially at or below this threshold of pain and even the discomfort point for sensitive people when filled with a hot beverage having an initial temperature of less than about 212° F.

In one aspect, the vents can be provided in a paperboard container material by first die cutting one or more shapes into the container material when the container is in web form. The shape of the vents is not believed to be critical, as long as the shape suitably allows air to freely flow through the container material sidewall during the film activation process.

For example, a U-shape can be cut into the container material which, in use, will provide a flap that operates as the vent. Other vent shapes suitable to provide a flap-type vent can be determined by one of ordinary skill in the art without undue experimentation. Examples of such alternative vent shapes are pictured in FIG. 4 herein.

It has been found that when a flap-type vent is used, it can be beneficial to provide the container for use with the flap slightly out of plane (that is, angled to the inner or outer portion of the container wall) so that air can readily flow through the container wall during activation of the shrink film. To this end, a pushing device, such as a pusher pin, can be used to ensure that the flap is slightly out of plane from the surface of the container material prior to formation of the container. By having a slightly opened flap, it has been found that air flow into the container sidewall is substantially instantaneous with the activation of the film.

Such substantially instantaneous air flow has been found to be particularly useful with the present invention because the activation of the shrink film is substantially instantaneous and coincident with the filling of the container with hot material. It has been found that when the liquid comes into contact with the film, the film immediately (or substantially immediately) shrinks. Thus, any significant delay in the air flow that limits the ability of the shrink film to fully activate has been found to reduce the insulation effectiveness of the container.

Still further, venting can be provided by punching holes into the container to provide air flow through the container sidewall. A die cutting device can be used to punch such structures out of the container material. It has been found that small holes should be provided when this method is used in order to minimize the appearance of holes in the container to the consumer. In one aspect, the holes are less than about 0.10 inches in diameter. Yet further, the holes are less than about 0.08 inches in diameter. Still further, the holes can be from about 0.05 to about 0.10 inches in diameter. Shapes other than circular can be used for the holes, such as square, triangular etc.

The vents can be positioned toward an upper region of the insulating band. Still further, the vents can be positioned in any position within the area of the insulating band.

The vents can vary in number, size and location and need not be all the same size, shape or dispersed uniformly within the area of the insulating band. The primary consideration regarding the vent characteristics is believed to be that shrinkage of the shrink film should not be unduly hindered by slow pressure equalization between ambient air and the forming air pocket, which forms substantially instantaneously upon contact of the shrink film with hot liquid, that is, liquid of at least about 130° F.

Suitable paperboard container material that can be used for the containers of the present invention is cupstock. Cupstock that can be used for the present invention includes solid bleached sulfate ("SBS") from Georgia-Pacific Corporation (Atlanta, Ga.). Any type of paperboard that can be used to prepare beverage containers are suitable for use to prepare the insulated containers of the present invention.

While paperboard material has been found to lend itself quite suitably to the present invention, the inventors believe that the methods of the present invention can be used for containers made from polymeric materials such as, for example, polystyrene and biodegradable polymeric materials such as polylactic acid. In this regard, it is contemplated that vents can be cut into a web of polymeric material before the shrink film is applied to the container sidewall to provide a polymer web-shrink film laminate from which a container blank can be cut. A bottom can be applied to the container blank to provide a two piece polymeric container. The methods of preparing such a container are known to those of ordinary skill in the art and, as such, will not be discussed in detail herein. It is contemplated that, regardless of whether the container is prepared from paperboard or other material, the vents will function to allow the formation of a suitable insulated area in the container when the container is filled with hot liquid.

When paperboard is used as the container material, the basis weight can be from about 120 to about 250 pounds per ream. As used herein, a ream is 3000 square feet of material. Yet further, when paperboard is used as the container material, the basis weight of the container material can be from about 160 to about 220 pounds per ream. Still further, when paperboard is used for the container material, the basis weight can be from about 120, 140, 160, 180, 200, 220, 240 or 250 pounds per ream, where any value can be used as an upper or a lower endpoint, as appropriate.

When paperboard is used for the container material, the material typically has a coating pre-applied to assist in making the container resistant to liquid. The coating can be on the inner surface of the container or on both the inner and outer surfaces of the container. Such a coating can be polyethylene or any other type of coating that is generally used for imparting liquid resistance to beverage containers. Such coatings are generally applied to the cupstock in an extrusion process as would be recognized by one of ordinary skill in the art. The coating also serves as the method of sealing the container in the forming process.

In order to provide the insulating band for the insulated beverage containers of the present invention made from paperboard, a polymeric shrink film is applied to one side of a web of the container material. While there are numerous temperature ranges in which shrink films can activate, the polymeric shrink film used in the present invention must exhibit suitable shrinkage under the temperatures exhibited by hot beverages. When subjected to heating resulting from contact with a hot material, the shrink film will shrink away from the sidewall of the container to provide an air-filled insulating band. In order to provide this band, the amount of shrinkage of the shrink film when contacted with a hot beverage having a temperature of from about 130° F. to up to about 212° F. can be from about 5% to about 50%, as measured by total area of the original area of the shrink film. Still further, the amount of shrinkage of the shrink film when contacted with a hot material having a temperature of from about 130° F. to about 212° F. can be from about 5, 10, 15, 20, 25, 30 or 35% of the total area of the shrink film, where any value can serve as an upper or a lower endpoint, as appropriate.

It will be recognized that, in use, the shrink film will not shrink unless a hot material comes into contact with the film. However, there will be no need for insulation if there is not a hot material contained in the container, so there will be no requirement for an insulating band to be formed if a lukewarm or cold beverage is contained within a container of the present invention. As such, the containers can be used for both hot and cold materials, beverage or otherwise.

It will be further recognized that shrinkage of the film will result in some loss of the total available volume of the container. In one aspect, the loss of volume from shrinkage of the shrink film is less than about 30%, where the amount of shrinkage is measured by the area difference in the shrink film as compared to the original area of the film prior to contact with hot liquid. Still further, the loss of volume from shrinkage of the shrink film is less than about 20%. Still further, the loss of volume from shrinkage of the shrink film is less than about 10%. Yet further, the loss of volume from shrinkage of the shrink film is less than about 5%.

To assist the user in filling the container, the interior of the container can be marked with a fill line to show the maximum volume to which the container can be filled without concern of overflow. However, a fill line is not necessary. Due to the shrinkage of the film being substantially simultaneous with the film coming into contact with the hot material, the final volume of the container is substantially immediately obtained as the hot material is added to the container. Put simply, although some volume loss will occur upon activation of the shrink film, such loss will not generally be noticeable by the consumer because the consumer will stop filling the container when the container is full.

In order to provide the consumer with the advertised serving size, the container will have to be larger than the final serving size to account for volume loss resulting from film activation. In this regard, the initial container volume (that is, the container having an unactivated film adhered to the interior thereof), will have a volume that is approximately larger than the final volume size. For example, initial container size for a final serving size of 12 ounces of hot liquid where the shrink film shrinks about 10% will be approximately 13.2 ounces.

The shrink film can comprise one or more layers of either or both of polyethylene or polypropylene. Suitable shrink films for use in the present invention include Clysar LLGT (60 gauge polyethylene film), VEZT (50 gauge 3 layer polypropylene/polyethylene/polypropylene film) and EZT (60 gauge 3 layer polypropylene/polyethylene/polypropylene film) (Bemis Clysar, Oshkosh, Wis.). Other suitable shrink films having the characteristics needed for use in the present invention can be identified by one of ordinary skull in the art without undue experimentation.

Suitable adhesives for use in the present invention are those that will not experience failure or marked deterioration of lamination strength upon contact with the hot liquid. As would be appreciated, if the adhesive fails or markedly deteriorates upon contact with hot liquid, the shrink film will pull away (that is, delaminate) from the sidewall of the container upon activation. If this happens, little or no insulation will be provided by the shrink film because the insulating band will not be suitably formed.

Accordingly, the adhesive used in the present invention will result in the shrink film undergoing substantially no delamination upon contact with hot material having an initial temperature of up to about 212° F. where the external (air) temperature is at about ambient, when the film is in contact with this hot material for at least about 5 minutes. While the adhesives used in the present invention can suitably provide good adhesion of the shrink film to the container surface for longer than 60 seconds, it will be appreciated that when the hot material is placed in the container, it will immediately begin to cool. As such, the hot material in the cup will decrease in temperature over time and the adhesive will be subjected to steadily decreasing temperatures as the hot material with which it is in contact cools.

An adhesive suitable for use in the present invention is Henkel GB-5458M, a product of Henkel Adhesives (Elgin, Ill.). A further suitable adhesive is BUV-008, a product of Royal Adhesives (South Bend, Ind.). Other suitable adhesives can be determined for use in the present invention by those of ordinary skill in the art without undue experimentation.

The adhesive can be applied to the container material in a shape that defines the area that will provide the insulation band perimeter. When applying the adhesive using a flexographic printing process, the adhesive can be applied to the web of container material in a pattern that follows the desired lamination locations for the film. As noted, in order to reduce areas in the container where insulation is limited, it can be desirable to minimize the area of the container wall covered by adhesive. Upon placement of the adhesive onto the interior surface of the container, a web of shrink film is brought into contact with the uncured adhesive that is laid out in the desired pattern on the web of container material. The adhesive can be applied to the container material so as to provide a peripheral attachment of the shrink film as shown, for example, in FIG. 3. The adhesive can also be applied to the web of container material in a pattern, such as those disclosed in U.S. Pat. Nos. 6,536,657 and 6,729,534 and U.S. Patent Publication No. 2005-0029337, the disclosures of which were previously incorporated by reference.

Alternatively, the adhesive can be applied to a web of shrink film material. In such an application, the container material is brought into contact with the shrink film web after application of the adhesive to the shrink film. When the adhesive is applied in this manner, further steps can be as discussed elsewhere herein.

It has also been found to be useful to reduce or eliminate adhesive in the area of the containers at which the seams of the container are located. Therefore, as illustrated by the shaded portion 47 of FIG. 3, the adhesive can be laid down in a pattern on the web of container material such that there is substantially no adhesive present on the container sidewall where the seams in the finished container will be located.

Figure 3:
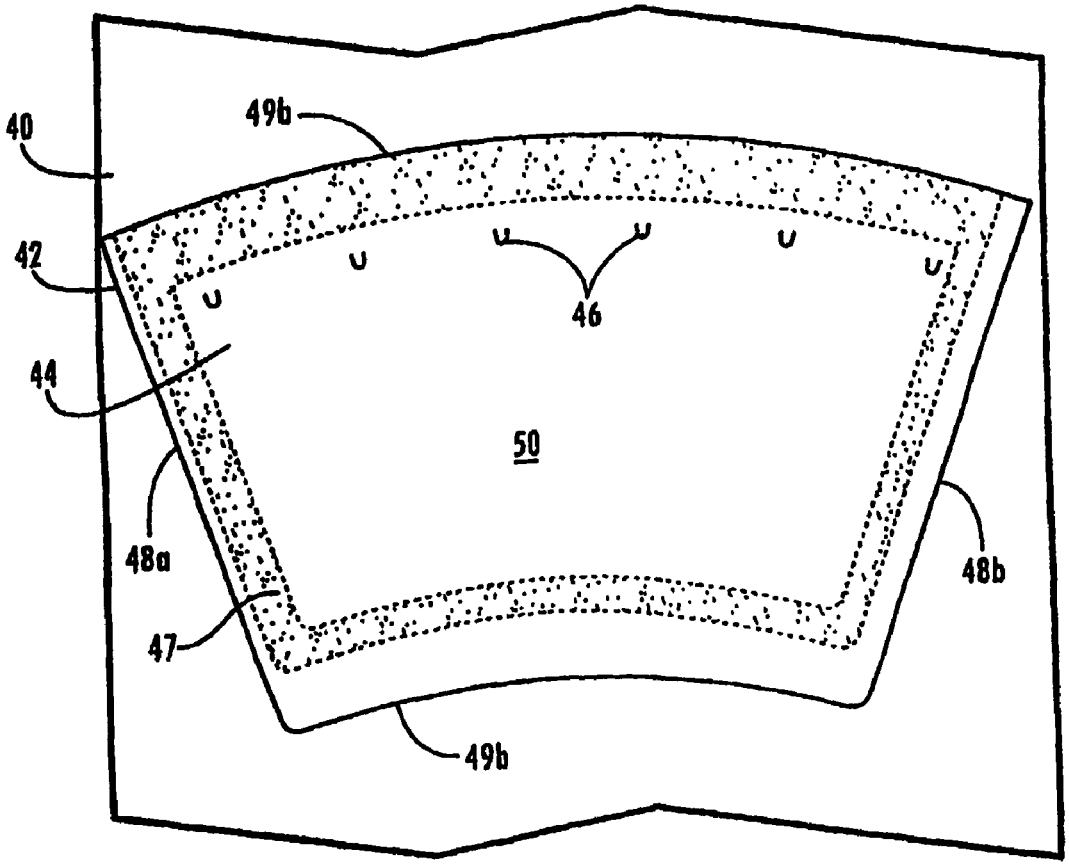
FIG. 3 is a layout of a web having the film adhered thereto for later cutting out into blanks.
Figure 5:
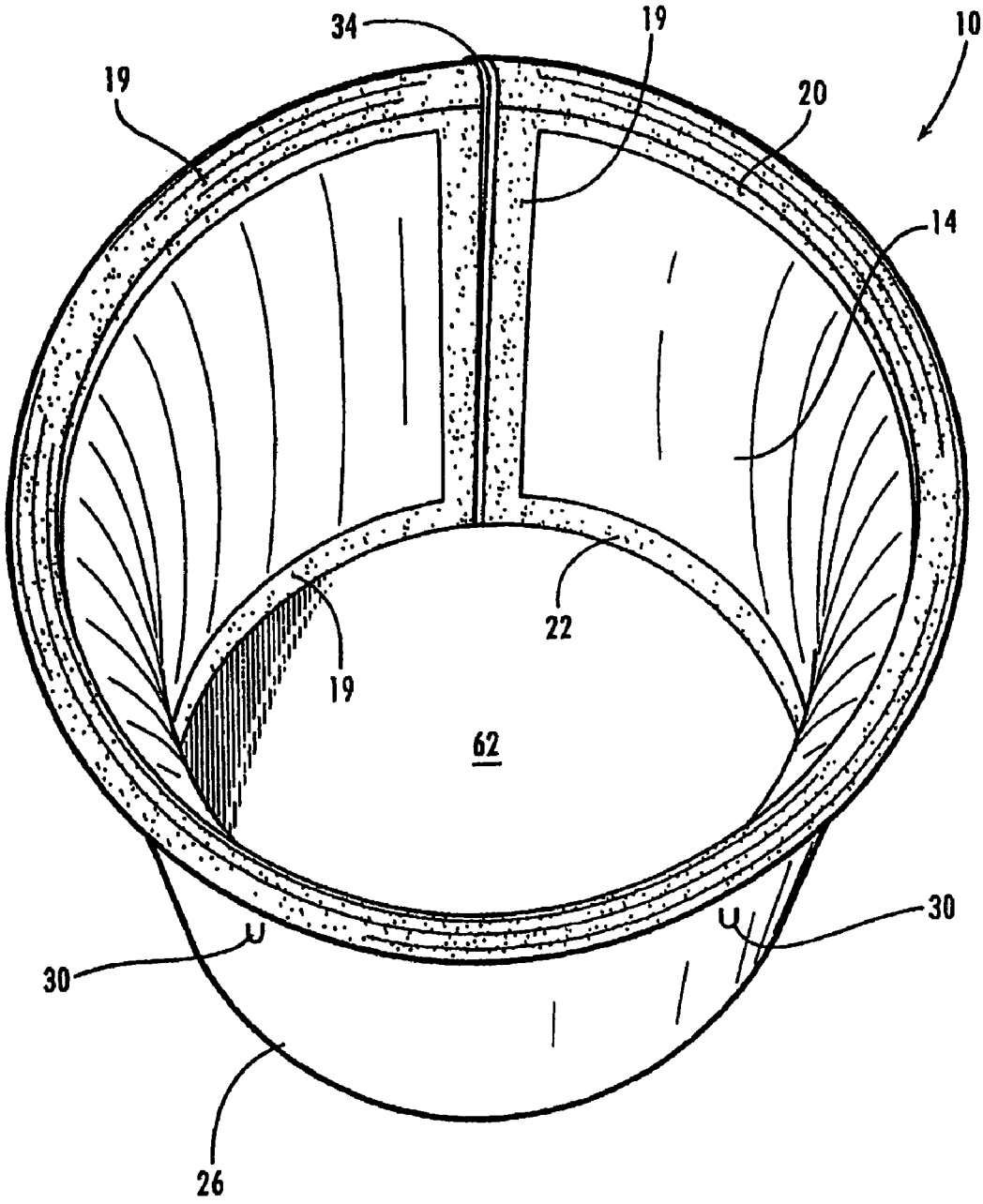
FIG. 5 is a perspective view of a container having an activated insulating film.

Blanks are cut from the laminate comprising the shrink film web and container material web to provide the desired final container shape. As seen in FIG. 3, the shaded portion 47 of the portion of the laminate (that will define the container blank when cut from the web) shows a suitable adhesive pattern to prepare a container of the present invention. As shown in FIG. 3, the adhesive can be applied up to the brim edge of what will be a container. The shrink film will then span the entire brim of the container in use. This is also shown in FIG. 5.

Additionally, FIG. 3 illustrates a suitable adhesive pattern whereby the adhesive is not applied to the outer portions of what will form the side and bottom seams. As noted, it has been found that reduction or elimination of the adhesive from the heat seal location can provide better cup formation and containers that are more likely to be leak-proof or substantially leak-proof. By providing a container seal area having substantially no adhesive present, it has been found possible to seal the containers using, for example, heat sealing of a polyethylene coating applied to the inner surface of the cupstock. Such polyethylene heat sealing allows the insulated containers of the present invention to be manufactured on conventional container manufacturing equipment, which greatly enhances the utility of the present invention.

In a method of making the container, the insulated container is prepared by providing a web of paperboard container material. The web is of a sufficient width to provide one or more container blanks cuttable from the web when the shrink film is adhered to the web using adhesives as discussed further herein. One or more vents are cut into the web using a suitable cutting apparatus. When the vents are U-shaped flaps, it can be beneficial to ensure that the flap is out of plane of the container. To this end, a pusher pin can be used to fully push the vents out of plane.

After cutting of the vents, the web can be rolled for future use, or the web can be immediately directed to the next processing step. In the adhesive application step, an adhesive can be printed on the web in a pattern coinciding with a perimeter of one or more container blanks that will be cut from the container material web. The number of container blanks that can be printed on the web is dependent on the web width and the characteristics of the printing equipment used in this process. When the container material web is printed with adhesive, one or more adhesive patterns are provided on the web.

While the adhesive is still tacky or "green," a web of shrink film is brought into contact with the web. The shrink film will therefore be adhered to the paperboard web where the adhesive has been printed on that web. A laminate comprising the shrink film and the container material is thus provided.

After the laminate is obtained, the laminate can be rolled for later use or can be in-line directed to a laminate cutting station. At this cutting station, the container blanks will be cut from the web. Referring to FIG. 3, because adhesive is substantially absent from the outer and lower sidewall edges 48*a*, 48*b* and 49*b*, when the container blank is cut from the container material-shrink film laminate, the shrink film will be adhered to the container sidewall as shown by the shaded portion 47.

When cut from the container material-shrink film laminate, the container blank is typically sent to a container forming station for preparation of the container. As noted, the present invention allows the use of conventional container forming equipment and methods. Such methods are well known and will not be discussed in detail herein except where the present invention has significant features in relation to these forming methods.

While the container forming methods are not discussed in detail, it is significant to the present invention that the side and lower outer edges of the container blank (48*a*, 48*b* and 49*b* in FIG. 3) do not have adhesive in the locations that will be joined at the side seam and bottom of the finished container. It has been found that the seal of the container (and thus the ability to obtain leak resistant or substantially leak resistant containers) can be markedly improved if the adhesive is absent or substantially absent from the seam locations in the finished container.

To form the seals of the finished container, the outer and lower edges of the container blank are pre-heated to melt the polyethylene located on the container blank. The container blank is then formed around a mandrel to form the side seam of the container. A separately cut bottom portion is then provided on the bottom of the partially finished container.

After formation of the container, a brim curl can be provided on the container using known methods. The containers are then provided for packaging and shipping using known methods.

Turning now to the drawings, FIG. 1 illustrates a partially cut away front perspective view of a container 10 having an activated shrink film 14. The container 10 formed from paperboard (such as SBS) has an activated shrink film 14 affixed to the inner surface 16 of the container 10 at the locations of adhesive 19, which are designated by shading the Figures. The intermediate portion of the activated shrink film 14 defines the activated shrink film 14 of the container 10, which is that portion between the upper and lower circumferential bands 20, 22 (which also correspond to locations of adhesive 19).

Still referring to FIG. 1, the sidewall 26 includes at least one vent 30 disposed within the activated shrink film 14 of the container 10. The vertical seam 34 of the insulated container 10 connects the two side edges (48*a* and 48*b* of FIG. 3) of the generally annular sector-shaped blank from which sidewall 26 is formed.

Figure 2:
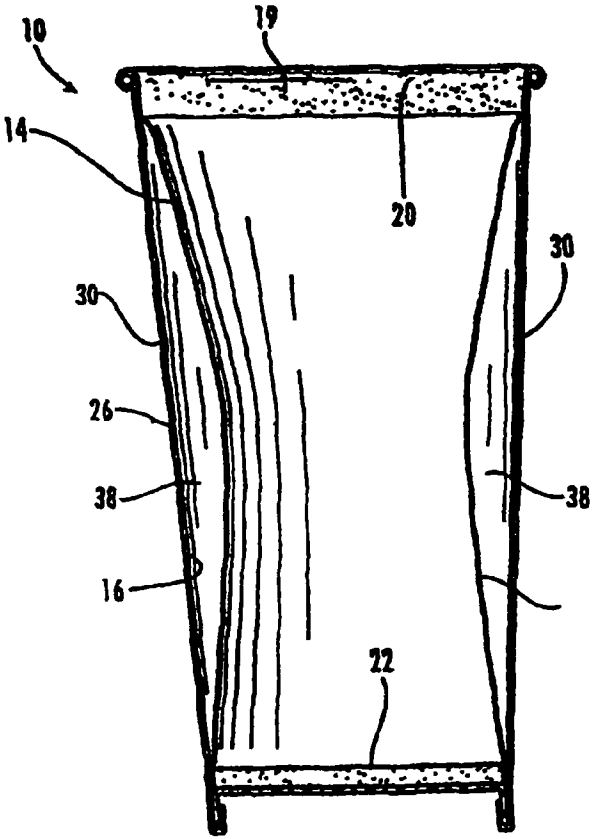
FIG. 2 is a vertical cross section of the activated container of FIG. 1.

Referring to FIG. 2, activated shrink film 14 of insulated container 10 is disposed away from the inner surface 16 of the sidewall 26. Activated shrink film 14 substantially surrounds the entire circumference of the container 10 and comprises a pocket 38 of ambient air that has passed through the vents 30 in the sidewall 26 upon contact of the activated shrink film 14 with hot liquid (not shown).

FIG. 3 illustrates an adhesive pattern for lamination of an unactivated shrink film 44 located in a portion of a web of container material 40. The lamination pattern includes a portion of container material web 42 onto which a web of shrink film 44 is laminated. The adhesive pattern (that is the area where the adhesive is printed on the web of container material 40) is shown by 47. 48*a*, 48*b* and 49*b* of the portion of container material web 42 are the outer edges where adhesive is absent. U-shaped vents 46 can be cut into the web of container material 40 in locations on the portion of container material web 42 corresponding to the insulated band 50 prior to lamination the shrink film 44 onto the web of container material 40.

Figure 4:
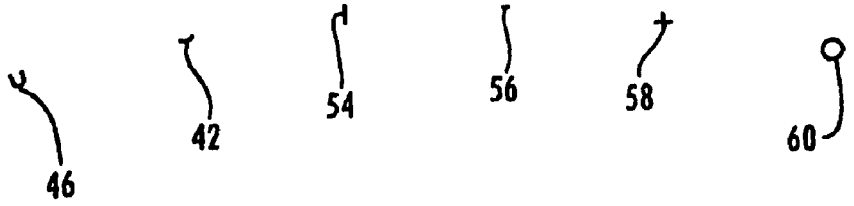
FIG. 4 shows different alternatives for the shape of the vents.

Alternative vent shapes and locations are depicted in FIG. 4. For example, the vents can be large flaps 46, small flaps 52, perforations 54 and 56, x-shaped cut-outs 58, round holes 60, or any other suitable shapes.

FIG. 5 is a perspective view of an activated container 10. Shaded portion 19 illustrates the locations where activated shrink film 14 is adhered to the inner portion of the container sidewall 26. Activated shrink film 14 (that is, the insulating band), of the activated container 10 can be activated by contact with hot liquid (not shown). The container sidewall 26 is attached to container bottom 62. Vents 30 are disposed in container sidewall 26.

EXAMPLES

The following Examples are put forth so as to provide those of ordinary skill in the art with a complete disclosure and description of how the present invention is practiced, and associated processes and methods are constructed, used, and evaluated, and are intended to be purely exemplary of the invention and are not intended to limit the scope of what the inventors regard as their invention. Efforts have been made to ensure accuracy with respect to numbers (e.g., amounts, temperature, et cetera.) but some errors and deviations should be accounted for. Unless indicated otherwise, parts are parts by weight, temperature is as specified or is at ambient temperature, and pressure is at or near atmospheric.

Example 1

Hold Times in Relation to Type of Shrink Film Used for Insulation Band

Figure 6:
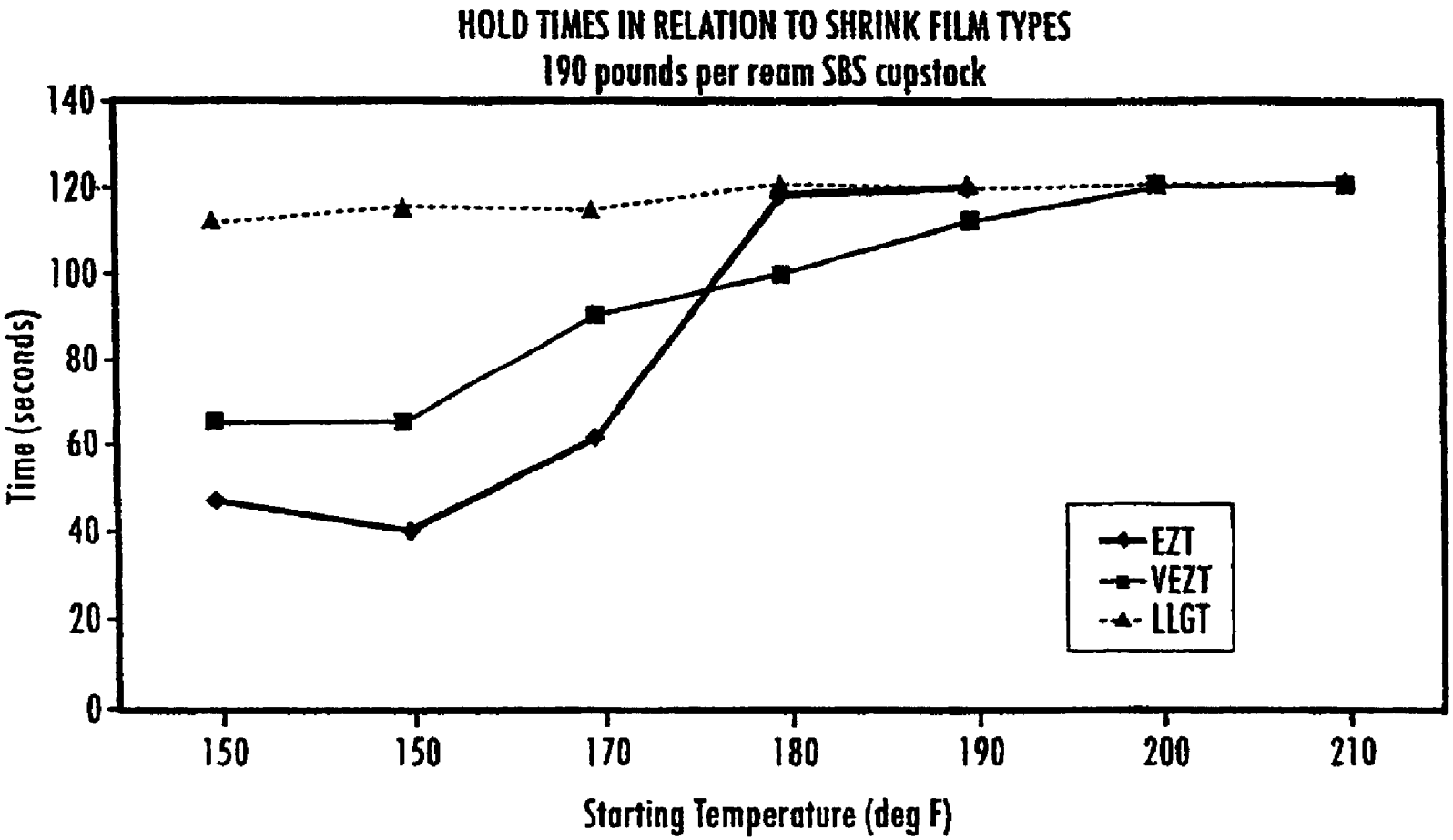
FIG. 6 is a plot of hold times for different types of shrink films.

FIG. 6 shows the results of hold time tests using different types of shrink films.

Hold time was measured using a panel of about 20 men and women (generally equally divided) who held containers filled with 190° F. liquid and were asked to indicate when the container became too hot to hold comfortably. Participants were directed to not hold the container at the seam position (which contained no insulation band). The test was stopped at 2 minutes (which was considered to conform to an infinite hold time).

The shrink films examined were: 1. Clysar LLGT (60 gauge polyethylene film); 2. VEZT (50 gauge 3 layer polypropylene/polyethylene/polypropylene film); and 3. EZT (60 gauge 3 layer polypropylene/polyethylene/polypropylene film). These were all products of Bemis Clysar, Oshkosh, Wis. The shrink film was applied in the pattern shown in FIG. 3. The adhesive used was Henkel 6B-5458M. The initial temperature of the liquid used to activate the shrink film was 190° F.

The results of this examination illustrated in FIG. 6 show that the type of shrink film used can have an effect on the insulation qualities of the container. It is believed that the differences in hold times (which directly relates to insulation effectiveness) are due to the temperature at which the shrink film experiences shrinkage. LLGT, which is polyethylene, experiences significant shrinkage at all temperatures tested. VEZT and EZT, which are each 3 layered films comprised of 2 polypropylene outer layers and a polyethylene inner layer, experience lesser shrinkage at lower temperatures. While these films do not show the same performance of LLGT, they still were judged to provide effective insulation and, as such, are suitable for use in the present invention.

Example 2

Cup Capacity in Relation to Type of Shrink Film Used for Insulation Band

Figure 7:
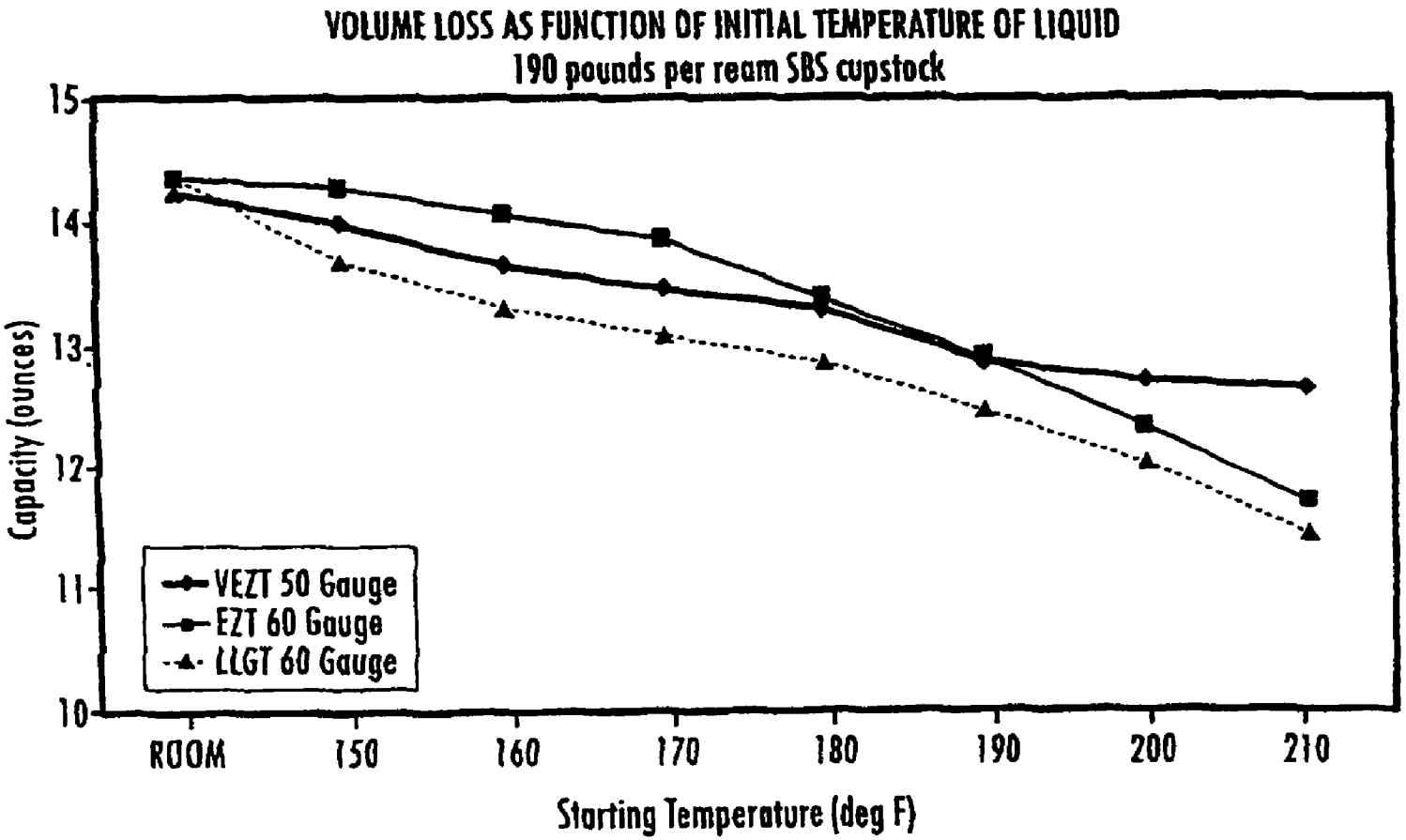
FIG. 7 is a plot of volume change with different types of shrink films.

FIG. 7 illustrates the loss of volume seen with different shrink film types. These results show that to obtain a final liquid volume of about 12 ounces, the unactivated container capacity needs to be larger to account for volume loss.

While the invention has been described in connection with numerous examples, modifications to those examples within the spirit and scope of the invention will be readily apparent to those of skill in the art. In view of the foregoing discussion, relevant knowledge in the art and references including co-pending applications discussed above in connection with the Background and Detailed Description, the disclosures of which are all incorporated herein by reference, further description is deemed unnecessary.

What is claimed is:

1. A method of making a container blank suitable for preparing an insulated container:

a) providing a container material web comprising paperboard, wherein the web is of a sufficient width to provide one or more container blanks cuttable from the web;

b) cutting the container material web so as to provide one or more vents in a sidewall of one or more container blanks cuttable from the web;

c) applying an adhesive to the container material web in a pattern approximately coinciding with a perimeter of one or more container blanks cuttable from the web, thereby providing one or more adhesive patterns on the container material web;

d) applying a shrink film web to the one or more adhesive patterns to provide a web-shrink film laminate, wherein the shrink film is adhered to the container material web at locations defined by the one or more adhesive patterns;

e) cutting the container material-shrink film laminate to provide one or more container blanks, wherein the container blanks comprise one or more vents in a location within a perimeter defined by the adhesive pattern, wherein the one or more vents substantially eliminate the formation of a vacuum in a space between the container material web and the shrink film during an activation of the shrink film;

wherein the container blank is suitable for preparing an insulated container.

2. The method of claim 1, further comprising:

a) providing the container blank, wherein the container blank has two outer edges and a bottom portion substantially free of the adhesive pattern;

b) heating the two outer edges and bottom portion;

c) forming the container blank on a mandrel to join the two outer edges;

d) applying a bottom to the container blank at the bottom portion;

thereby providing a substantially leak resistant container suitable for providing insulation when filled with a liquid having a temperature from about 130° F. to up to about 212° F.

3. The method of claim 2, wherein the vents are of a size and shape suitable to allow air to freely flow through the sidewall during activation of the shrink film.

4. The method of claim 2, wherein the shrink film is activatable when contacted with a material having an initial temperature from about 130° F. to about 212° F.

5. The method of claim 2, wherein the paperboard has a basis weight of from about 160 to about 220 pounds per ream.

6. The method of claim 2, wherein the one or more vents are U-shaped.

7. The method of claim 2, wherein the one or more vents each, independently, comprise a hole having a diameter of from about 0.05 to about 0.1 inches in diameter.

8. The method of claim 2, wherein the one or more vents each, independently, is greater than about 10 times the area of a pinhole.

9. The method of claim 2, wherein the shrink film does not substantially delaminate from the container when the container is contacted with a material having an initial temperature from about 130° F. to about 212° F.

10. The method of claim 2, wherein the shrink film comprises one or more layers of polyethylene or polypropylene.

11. A method of making a container blank suitable for preparing an insulated container:

a) providing a container material web comprising paperboard, wherein the web is of a sufficient width to provide one or more container blanks cuttable from the web;

b) cutting the container material web so as to provide one or more vents in a sidewall of one or more container blanks cuttable from the web;

c) providing a shrink film web, wherein the shrink film is activatable by contact with a hot material having an initial temperature of from about 130° F. to up to about 212° F.;

d) applying an adhesive in an adhesive pattern to the shrink film web, wherein the pattern coincides with a perimeter of one or more container blanks cuttable from the shrink film web, thereby providing one or more adhesive patterns on the shrink film web;

e) marrying the shrink film web with the container material web, thereby providing container material-shrink film laminate, wherein the container material is adhered to the shrink film web in the locations defined by the adhesive pattern;

f) cutting the container material-shrink film laminate to provide one or more container blanks, wherein the container blanks comprise one or more vents in a location within a perimeter defined by the adhesive pattern, wherein the one or more vents substantially eliminate the formation of a vacuum in a space between the container material web and the shrink film during an activation of the shrink film;

wherein the container blank is suitable for preparing an insulated container.

* * * * *